US007682038B2

(12) United States Patent
Wood

(10) Patent No.: US 7,682,038 B2
(45) Date of Patent: Mar. 23, 2010

(54) PORTABLE LIGHT HAVING MULTI-MODE REFLECTOR

(75) Inventor: Brian Wood, McKinney, TX (US)

(73) Assignee: The Brinkman Corporation, Dallas, TX (US)

( * ) Notice: Subject to any disclaimer, the term of this patent is extended or adjusted under 35 U.S.C. 154(b) by 0 days.

(21) Appl. No.: 11/205,837

(22) Filed: Aug. 16, 2005

(65) Prior Publication Data

US 2007/0064415 A1 Mar. 22, 2007

(51) Int. Cl.
*F21L 4/00* (2006.01)

(52) U.S. Cl. ..... 362/187; 362/188; 362/280; 362/281; 362/205

(58) Field of Classification Search ..... 362/205, 362/296, 297, 346, 465, 512, 514–519, 360, 362/341, 197, 538, 310, 208, 277, 280, 281, 362/302, 304, 319, 347, 271, 274, 284, 324, 362/306, 187, 188, 198–199; 313/113–114
See application file for complete search history.

(56) References Cited

U.S. PATENT DOCUMENTS 2,188,129 A * 1/1940 Ayotte ..... 362/188
2,338,078 A * 12/1943 Wood ..... 362/187
3,316,398 A * 4/1967 Dayton et al. ..... 362/277
4,462,067 A * 7/1984 Altman ..... 362/268
4,703,401 A * 10/1987 Ichihara et al. ..... 362/517
5,130,904 A * 7/1992 Ohshio et al. ..... 362/516
5,816,688 A * 10/1998 Shui-Shang ..... 362/253
6,004,008 A 12/1999 Lai
6,027,226 A 2/2000 Shiau
6,039,466 A * 3/2000 Duchenne et al. ..... 362/515
6,174,071 B1 1/2001 Chan
6,354,722 B1 * 3/2002 Montenegro et al. ..... 362/514
6,364,504 B1 * 4/2002 Hon ..... 362/208
6,435,703 B2 * 8/2002 Takada ..... 362/517
6,447,153 B1 * 9/2002 Kawamura ..... 362/507
6,626,565 B2 * 9/2003 Ishida ..... 362/514

* cited by examiner

*Primary Examiner*—Jong-Suk (James) Lee
*Assistant Examiner*—Kevin J. Spinella
(74) *Attorney, Agent, or Firm*—Sheppard, Mullin, Richter & Hampton LLP

(57) ABSTRACT

A portable light is provided having a reflector assembly configured to create multiple modes of light reflection. The reflector assembly surrounds a light source and has first and second reflectors that together define a substantially continuous reflective surface. The second reflector is mounted for axial movement relative to the first reflector. Thus, different modes of light reflection can be produced. In an exemplary embodiment, the second reflector is disposed within a central opening defined by the first reflector, and the reflectors combine to define a substantially parabolic reflective surface, with the light source disposed at a focal point.

13 Claims, 7 Drawing Sheets

PORTABLE LIGHT HAVING MULTI-MODE REFLECTOR

BACKGROUND OF THE INVENTION

The present invention relates generally to portable lights such as spotlights, flashlights, and the like, and, more particularly, to portable lights having a multi-mode reflector.

Portable lights such as spotlights and flashlights typically include a light source, such as a lamp bulb, surrounded by a concave reflector to reflect the light from the lamp bulb and direct the light through a lens covering the open end of the reflector. In general, the light source can be selected from a number of different types of sources, including incandescent, halogen, xenon, or light emitting diode (commonly referred to as "LED"). In such portable lights, the reflector can have a parabolic or non-parabolic shape and the positional relationship between the lamp bulb and the reflector can be fixed or variable.

When the relationship between the lamp bulb and the reflector is fixed, a parabolic reflector may be used to achieve a focused spot beam of light. In that case, the lamp bulb—or more specifically, its light emitting element, such as the filament in the case of an incandescent source—is disposed at the focal point of the parabolic reflector, so that the light rays project generally parallel to each other from the reflector. Since the light is concentrated, spot beams are useful for illuminating a particular object. For other applications, it is desirable to provide broader, more dispersed light pattern than that provided by a spot light pattern. To that end, for example, flashlights have been provided that include a non-parabolic reflector configured to achieve a broad, dispersed light pattern.

For purposes of achieving a variable light pattern, the lamp bulb and reflector can be movable relative to one another along an optical axis of the reflector. This focusing adjustment can be accomplished by mounting either the lamp bulb or the reflector in a fixed position on the portable light, and providing means to move the other component relative to it, or the lamp bulb and reflector can be mounted so that both move. Whatever the arrangement, when the lamp bulb and reflector are displaced relative to one another so that the lamp bulb is not at the focal point of the reflector, the light rays diverge from the central axis, creating a comparatively broader beam as compared to having the lamp bulb at the focal point. Although such flashlights provide different modes of light patterns, shortfalls exist. For example, when the lamp bulb is not at the focal point, an un-illuminated, or dimly illuminated spot typically results at the center of the light pattern, which is undesirable in most uses. Moreover, the size of the un-illuminated center becomes exacerbated with distance.

It should, therefore, be appreciated that there exists a need for a portable light that solves that aforementioned problems. The present invention fulfills this need and others.

SUMMARY OF THE INVENTION

The invention provides a portable light having a reflector assembly configured to provide multiple modes, or multi-modes, of light reflection. The reflector assembly surrounds a light source and has first and second reflectors that together define a substantially continuous reflective surface. The second reflector is mounted for axial movement relative to the first reflector. Thus, different modes of light reflection can be produced.

In selected embodiments, the reflectors combine to define a substantially parabolic reflective surface, with the light source disposed at a focal point. The second reflector is disposed within a central opening defined by the first reflector.

In an exemplary embodiment, first and second modes of light reflection are provided, each having a distinct light pattern. A user can easily switch between the modes as desired. To that end, the user engages a mode switch disposed on the portable light. The switch is operatively connected to the second reflector, e.g., via a lever disposed within the housing, to move the second reflector relative to the first reflector.

In a detailed aspect of an exemplary embodiment, the reflector assembly includes an inner reflector disposed in the central opening of an outer reflector. The inner reflector is mounted for axial movement along the projection axis relative to outer reflector. The portable light further includes a light source fixed relative to the inner reflector, at a focal point thereof. In a first position, the reflectors combine to define a substantially parabolic reflective surface.

In another detailed aspect of an exemplary embodiment, a plurality of pins project rearward from the outer reflector through corresponding openings in the inner reflector for connecting the inner and the outer reflectors. A plurality of springs are disposed about a corresponding pin.

For purposes of summarizing the invention and the advantages achieved over the prior art, certain advantages of the invention have been described herein. Of course, it is to be understood that not necessarily all such advantages may be achieved in accordance with any particular embodiment of the invention. Thus, for example, those skilled in the art will recognize that the invention may be embodied or carried out in a manner that achieves or optimizes one advantage or group of advantages as taught herein without necessarily achieving other advantages as may be taught or suggested herein.

All of these embodiments are intended to be within the scope of the invention herein disclosed. These and other embodiments of the present invention will become readily apparent to those skilled in the art from the following detailed description of the preferred embodiments having reference to the attached figures, the invention not being limited to any particular preferred embodiment disclosed.

BRIEF DESCRIPTION OF THE DRAWINGS

Embodiments of the present invention will now be described, by way of example only, with reference to the following drawings in which.

DETAILED DESCRIPTION OF THE PREFERRED EMBODIMENTS

Figure 1:
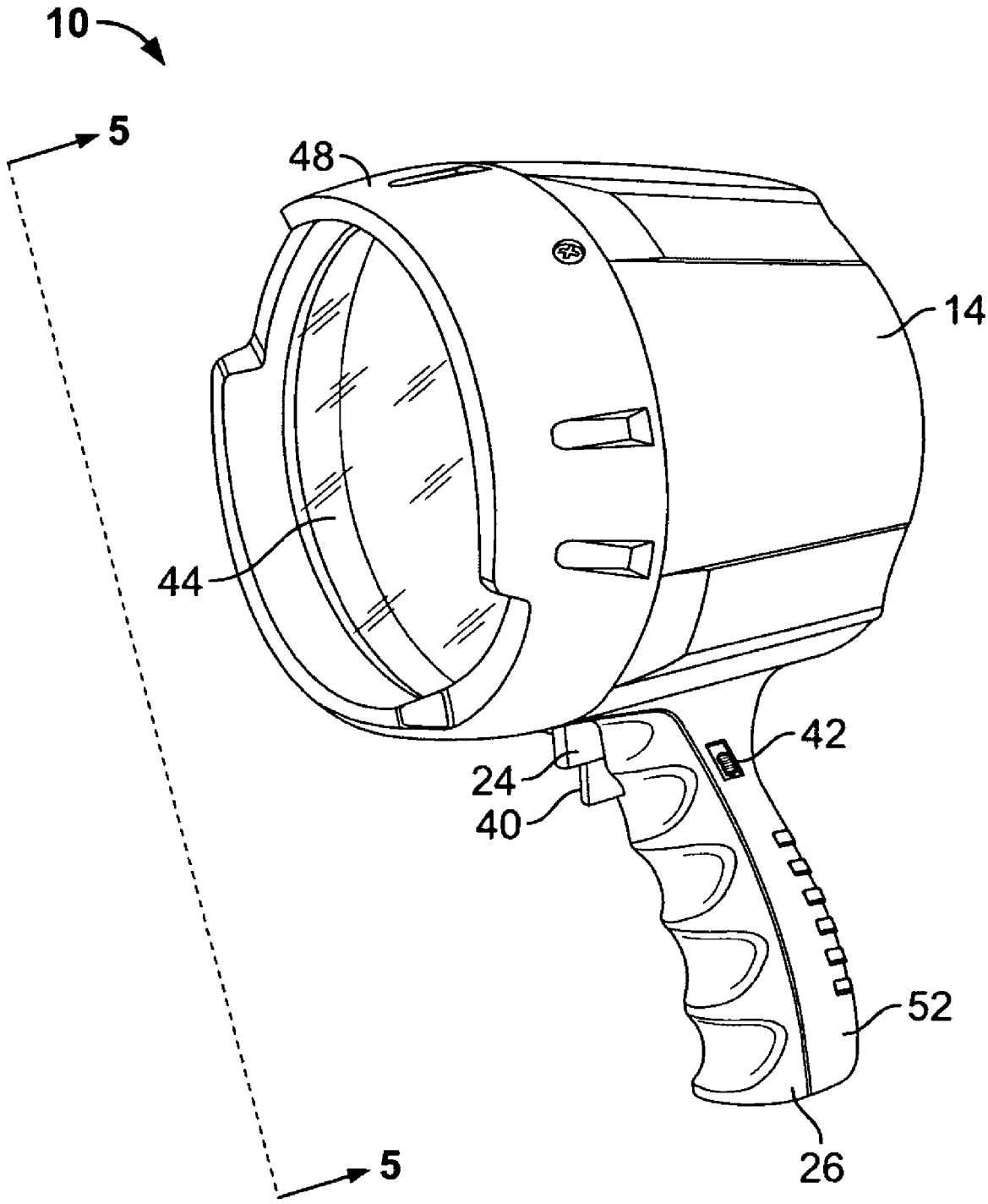
FIG. 1 is a perspective view of a portable light in accordance with the invention.
Figure 2:
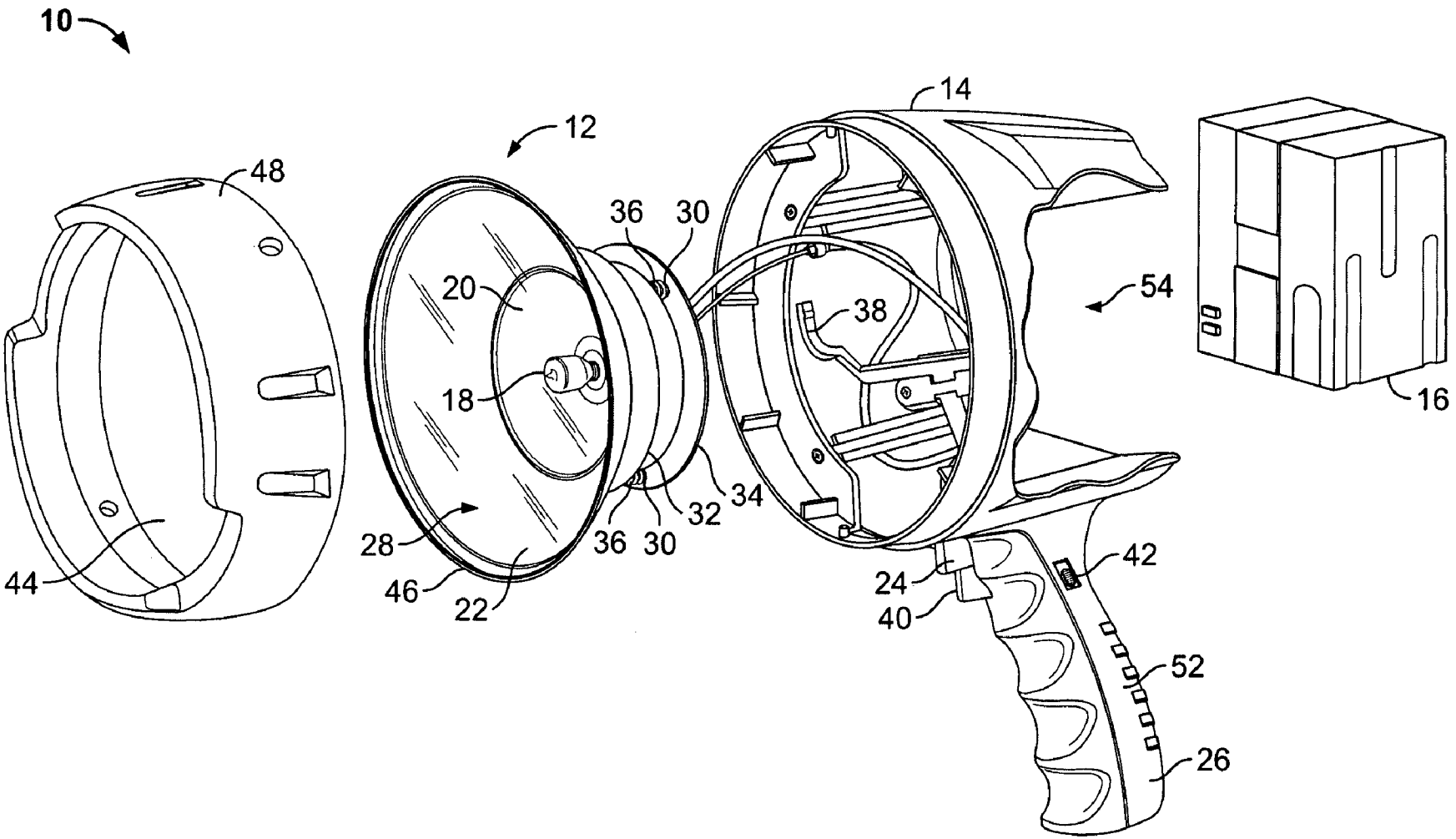
FIG. 2 is an exploded perspective view of the portable light of FIG. 1, depicting a reflector assembly received within a housing.

With reference now to the drawings, and particularly FIGS. 1 and 2, there is shown a portable light 10 having reflector assembly 12 configured to provide multiple modes of light reflection. The portable light includes a housing 14, enclosing the reflector assembly and rechargeable battery 16. The reflector assembly surrounds a light source, lamp bulb 18, and includes an inner reflector 20 and an outer reflector 22. As shown in FIG. 2, the light source is a bi-pin incandescent lamp bulb, but another type of light source could be used. The light source is fixed relative to the inner reflector, and the inner reflector is movable relative to the outer reflector. Thus, different modes of light reflection can be produced. In the exemplary embodiment, first and second modes are provided, each having a distinct light pattern, substantially free of un-illuminated regions. A user can easily switch between the modes using a mode switch 24 located on a handle 26 of the portable light.

Figure 6:
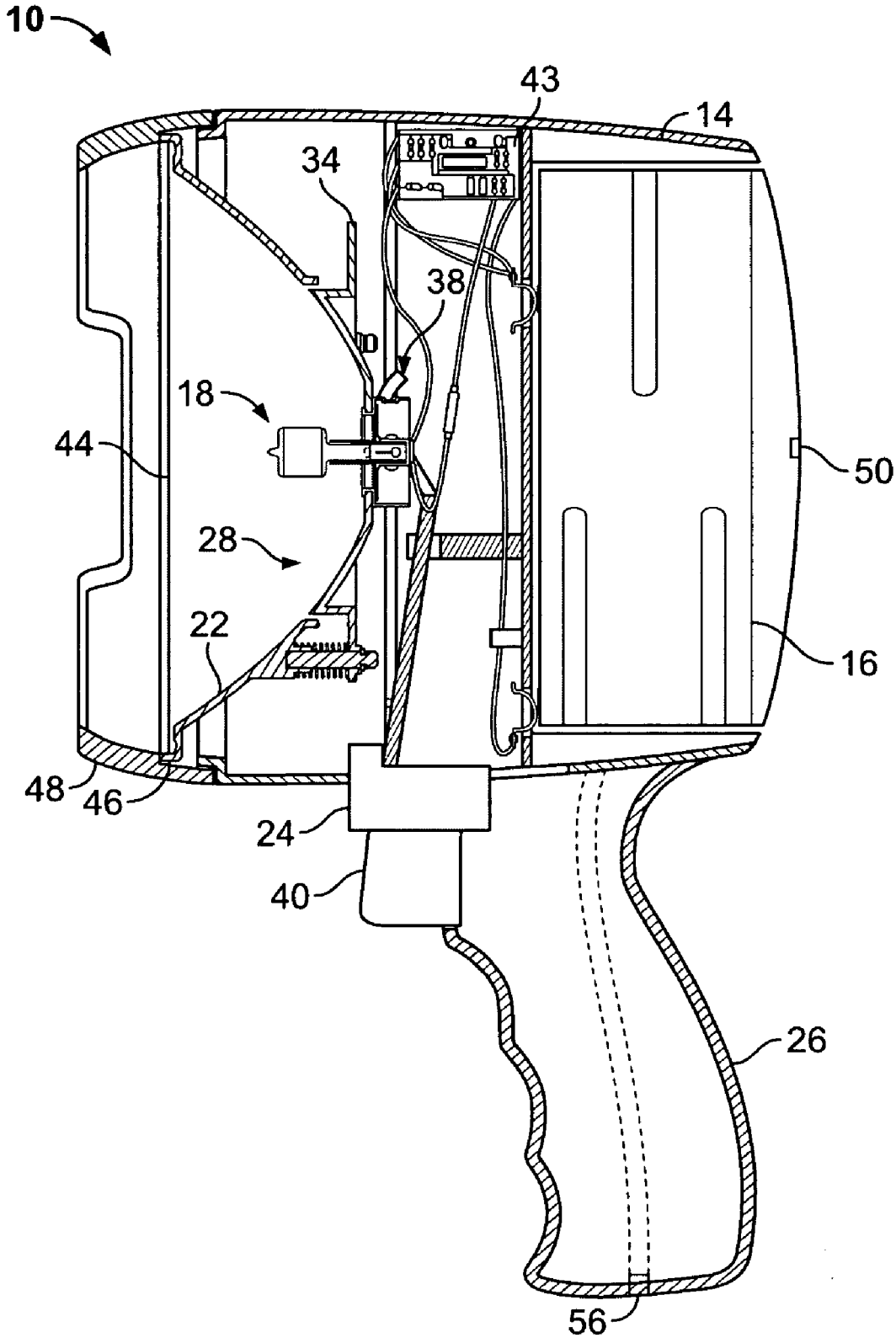
FIG. 6 is a cross-sectional view, similar to FIG. 2, depicting the reflector assembly in a first position and defining a parabolic reflective surface in spot mode.

In the first mode (FIG. 6), the inner reflector 20 and the outer reflector 22 combine to define a parabolic reflective surface 28. The lamp bulb 18 is mounted to the inner reflector such that its filament is generally aligned with the focal point of the parabolic surface. Thus, the light projects generally parallel to a reflection axis (R), creating a spot pattern.

Figure 7:
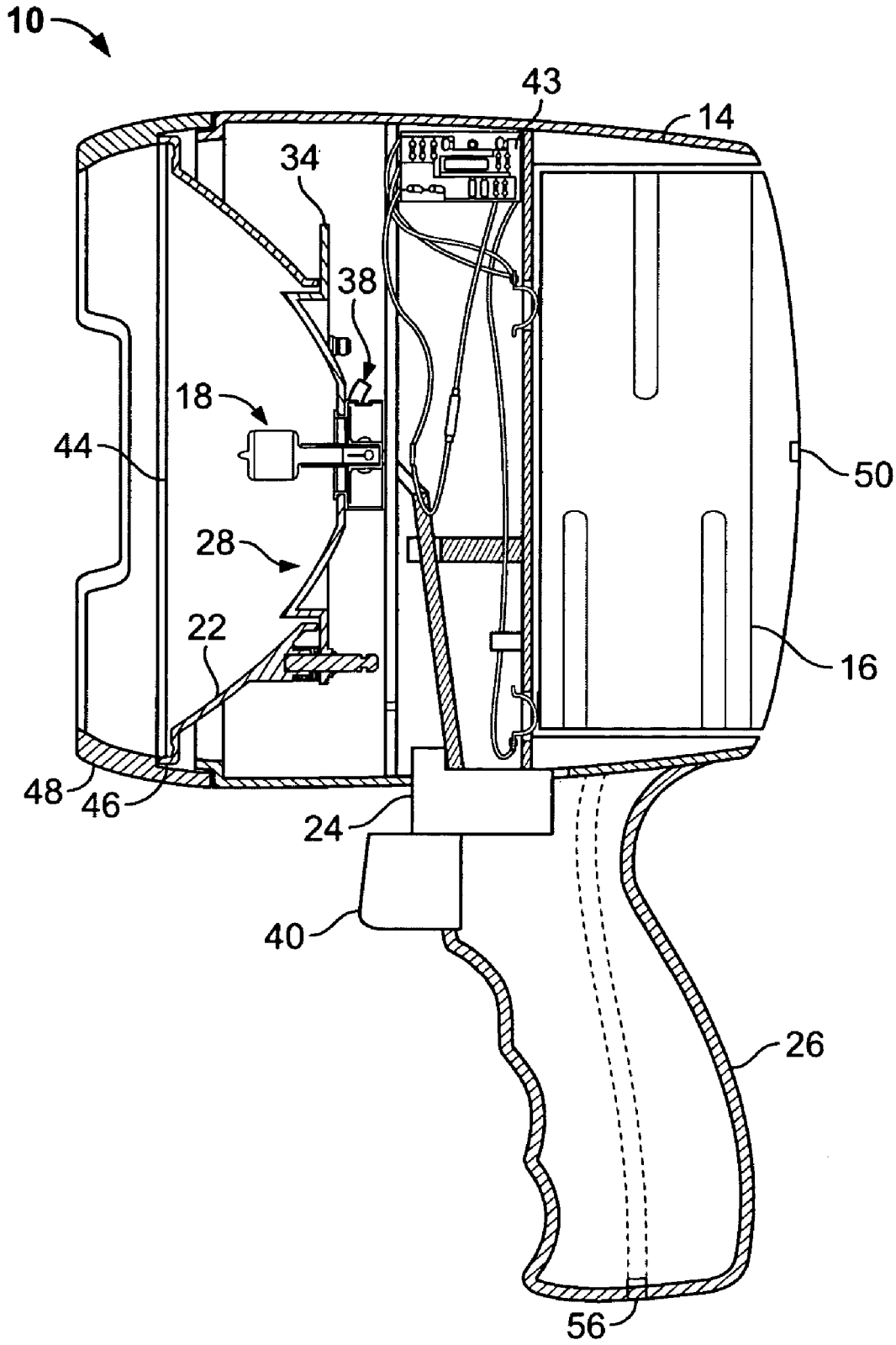
FIG. 7 is a cross-sectional view of the reflector assembly, similar to FIG. 2, depicting the reflector assembly in a second position in flood mode.

In the second mode (FIG. 7), the inner reflector 20 is disposed in a forward position. Since the lamp bulb 18 is fixed relative to the inner reflector, the lamp bulb is still at the focal point of the inner reflector. Thus, the light reflected off the inner reflector projects generally parallel to a reflection axis (R). In the forward position, the lamp bulb is offset from the focal point of the outer reflector. Thus, the light reflected off the outer reflector projects at an angle relative to the reflection axis. In this manner, a broad light pattern is provided by the outer reflector, while at the same time a focus spot is provided by the inner reflector.

Figure 3:
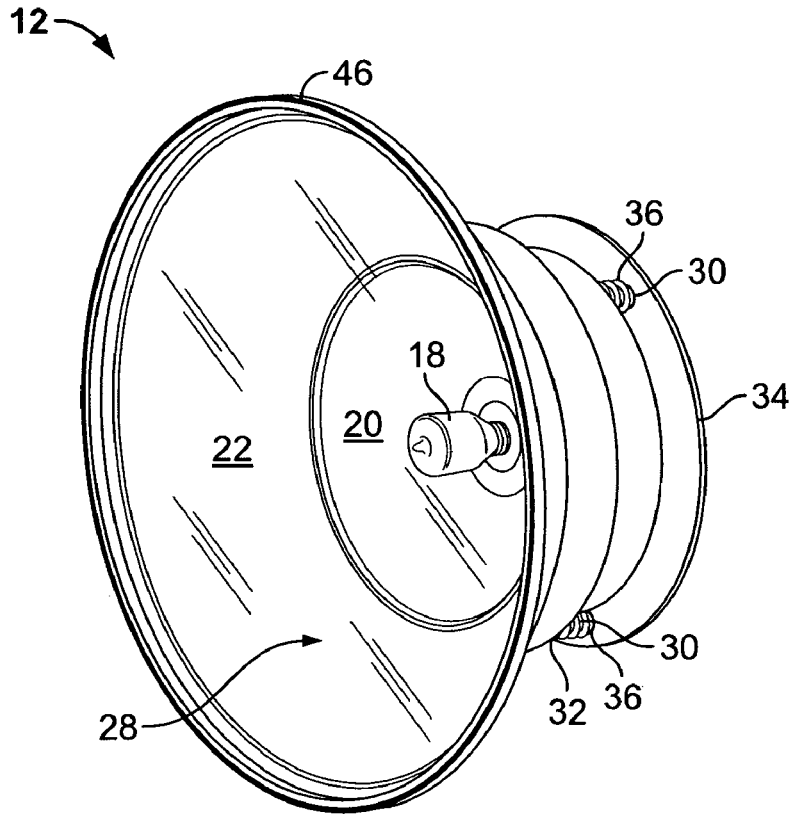
FIG. 3 is a perspective view of the reflector assembly of the portable light of FIG. 1, depicting an outer reflector and a movable inner reflector, together defining a parabolic reflective surface.
Figure 4:
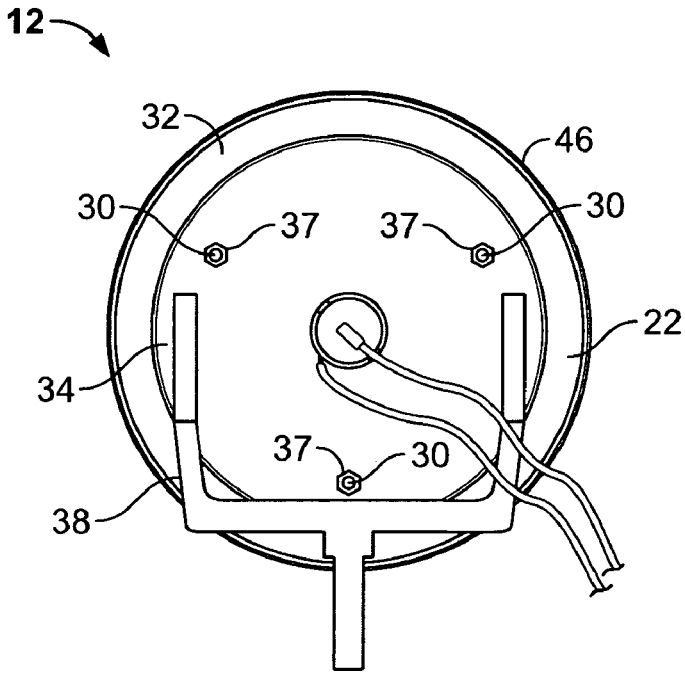
FIG. 4 is a back plan view of the reflector assembly and lever arm of the portable light of FIG. 1, depicting the engagement positions of the lever arm on a support plate of the reflector assembly.

With reference now to FIGS. 3 and 4, the inner reflector 20 is mounted for movement within a center aperture defined by the outer reflector 22. The outer reflector includes three pins 30 (shown in FIG. 4), extending rearward and spaced equiangularly about a rear surface 32 of the outer reflector and equidistant from the center of the inner reflector. The inner reflector includes a support plate 34 that defines holes aligned with the pins of the outer reflector. The pins are threaded for receiving nuts 37 to secure the reflectors together. Springs 36 are disposed about the pins and are configured to engage the rear surface of the outer reflector and the support plate of the inner reflector to bias the inner reflector to its first position.

Figure 5:
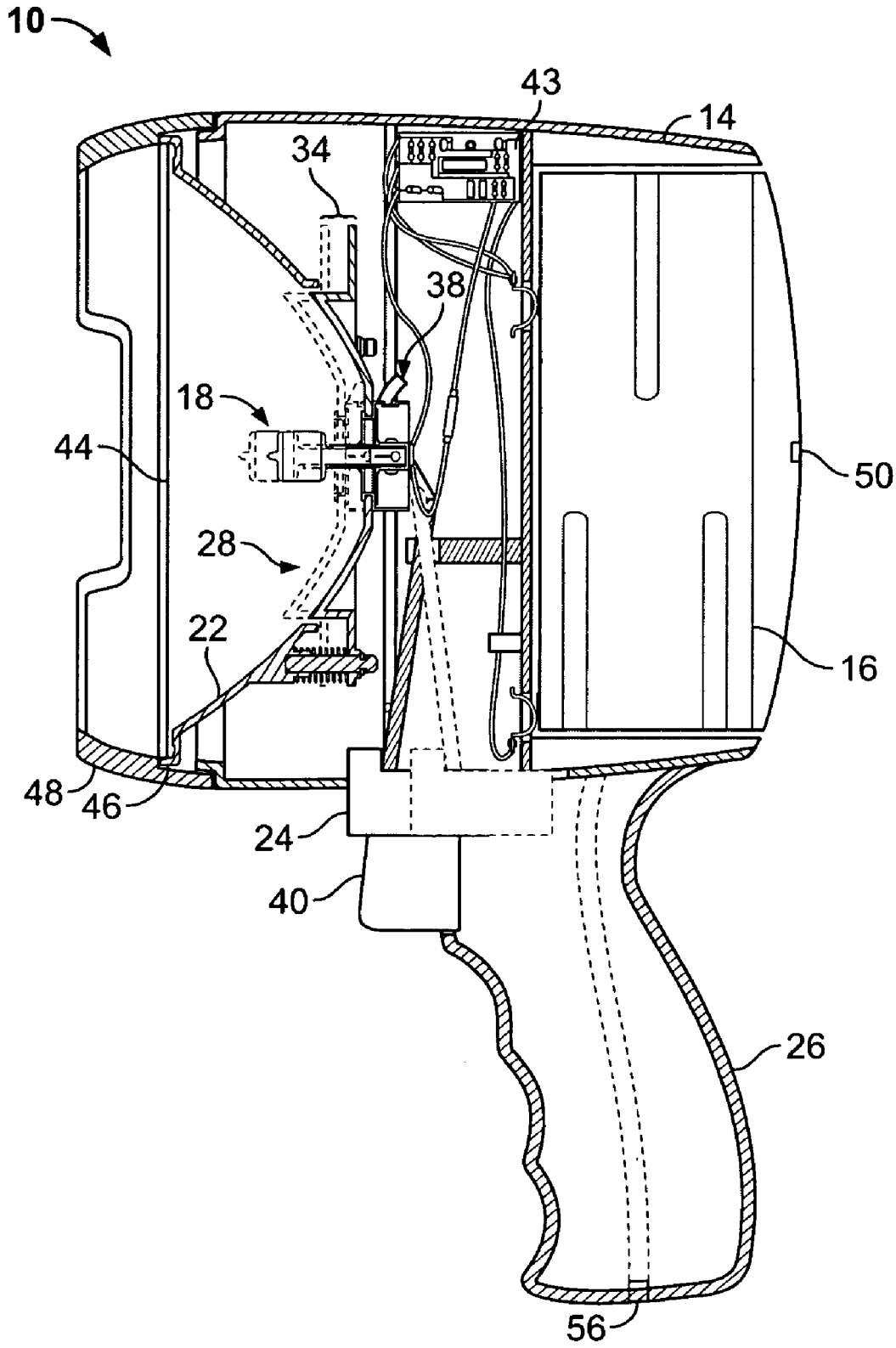
FIG. 5 is a cross-sectional view, taken along line 5-5, of the portable light of FIG. 1, depicting a mechanism for moving the inner reflector.

With reference now to FIG. 5, the portable light 10 further includes a mechanism for moving the inner reflector 20, which includes the mode switch 24. In the exemplary embodiment, the mode switch 24 is positioned adjacent to and partially recessed within the handle 26 and is operatively connected to a lever arm 38 disposed within the housing and configured to engage the support plate 34 of the inner reflector 20. In use, depressing the mode switch causes the lever to press against the support plate to move the inner reflector forward to the second position. When, the mode switch is released, the inner reflector resumes its first position. Thus, a user can conveniently toggle between the first and second modes, as desired.

A trigger button 40 is positioned adjacent to and partially recessed within the handle 26 and is coupled to an electrical circuit 43 located within the cavity and configured to operate the lamp bulb 18. Depressing the trigger button turns the bulb on and releasing the trigger button turns the bulb off. When the trigger button is in the on or off position it can be locked in place using a trigger lock 42, also provided on the handle. With the trigger button in the on position, the trigger button can be locked in place by engaging the trigger lock. The trigger lock allows the portable light to remain in the on position without having to press the trigger button continuously.

A plastic lens 44 is located beyond a distal edge 46 of the outer reflector 22. The plastic lens is supported by a head assembly 48 that fits over the reflector and is attached to the housing 14. An open front end of the housing has external threads to fit together with internal threads of the head assembly. In other embodiments, the head assembly can be attached to the housing by other methods, e.g., snap-fit, screws, bolts, and so on.

The housing 14 and the handle 26 are integrally formed and are made from a durable plastic material. The handle protrudes from the bottom rear portion of the housing and is adapted to be held by a person's hand for directing light from the portable light to a specific location. The housing is cylindrical in shape, though, in other embodiments, various other shapes can be used, as desired. A rear portion 52 of the handle is covered using a rubber or elastomeric material to provide a better grip with the person's hand.

The rechargeable battery 16 is mounted in a rear opening 54 (FIG. 2) of the housing and is electrically connected to the lamp bulb 18. The battery includes a first socket 50 for receiving a recharging cord (not shown). Alternatively, the portable light can be powered using an external power supply (not shown). The external power source is connected through a second socket 56 located in a base wall of the handle 26 via a cord (not shown). When using the external power source, the batteries do not have to be in place for the portable light to operate.

Figure 8:
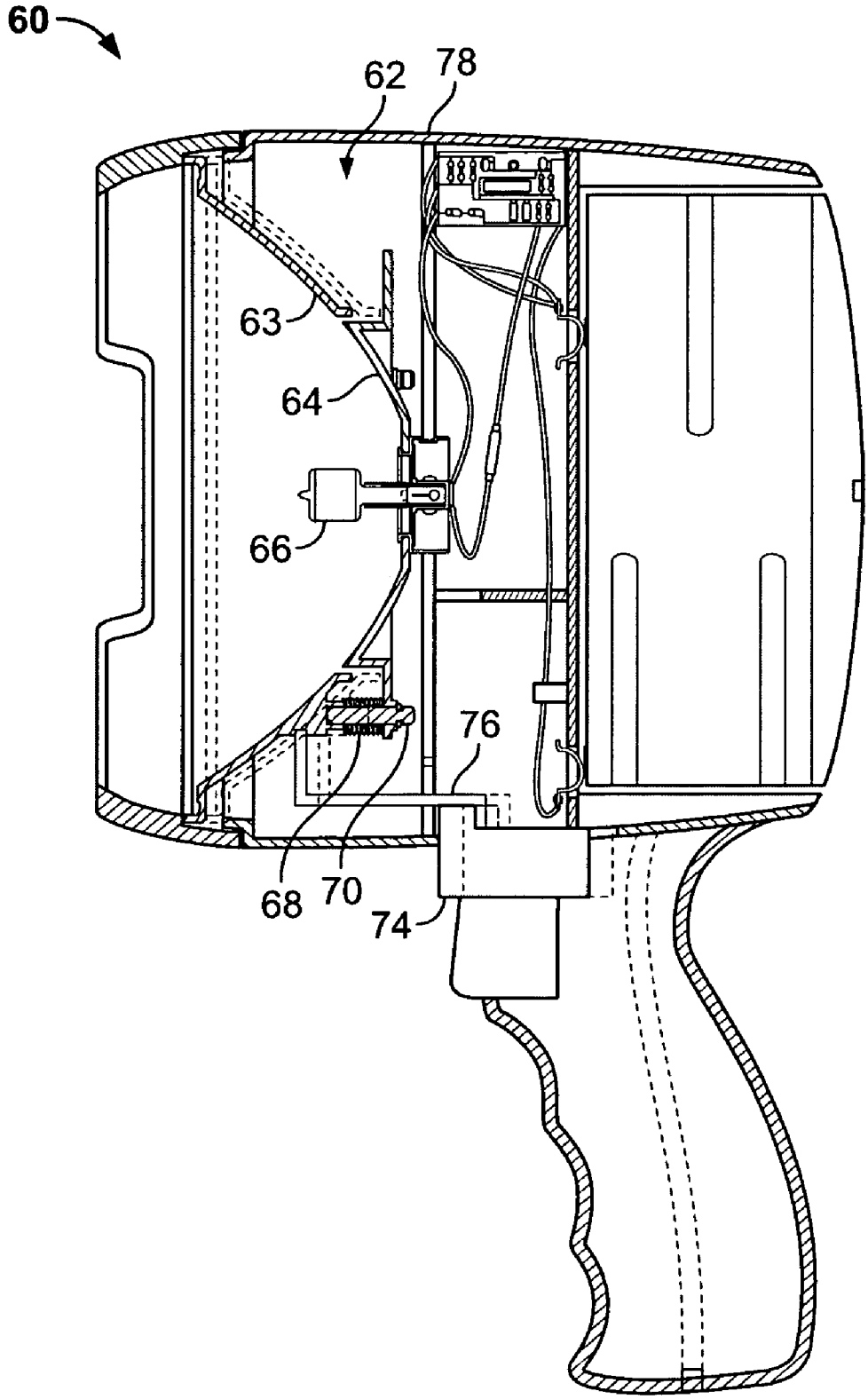
FIG. 8 is a cross-sectional view, similar to FIG. 3, of a second embodiment of a portable light in accordance with the invention.

With reference now to FIG. 8, a second embodiment of a portable light 60 is shown, including a reflector assembly 62 having an outer reflector 63 that moves relative to an inner reflector 64 to provide multi-mode reflection. A light source 66 is provided, fixed relative to the inner reflector. Springs 68 and pins 70 are disposed about a rear surface of the outer reflector such that the outer reflector is biased in a forward position. In this biased position, the reflectors combine to define a parabolic surface. A mode switch 74 is operatively connected to the outer reflector via a lever arm 76 to move the outer reflector rearward upon activation of the switch. The inner reflector is fixed relative to the housing 78. Thus, activation of the mode switch achieves a relative orientation between the reflectors similar to that depicted in FIG. 7.

It should be appreciated from the foregoing that the present invention provides a portable light having a reflector assembly configured to provide multiple modes of light reflection. The reflector assembly surrounds a light source and has first and second reflectors that together define a substantially continuous reflective surface. The reflector assembly is configured such that the first reflector and the second reflector can be axially displaced relative to each other. Thus, different modes of light reflection can be produced.

Although the invention has been disclosed in detail with reference only to the preferred embodiments, those skilled in the art will appreciate that various other embodiments can be provided without departing from the scope of the invention. Accordingly, the invention is defined only by the claims set forth below.

What is claimed is:

1. A handheld portable light, comprising:

a housing including a handle;

a light source disposed within the housing; and a reflector assembly disposed within the housing about the light source and defining a projection axis, the reflector including a first reflector and a second reflector, the first reflector and the second reflector together defining a substantially continuous reflective surface in a first position relative to one another, wherein the first reflector is disposed within a central opening defined by the second reflector such that the second reflector surrounds the first reflector, wherein the light source and the first reflector are fixedly positioned together such that the position of the first reflector relative to the light source does not vary, and wherein the reflector assembly is configured such that the first reflector and the second reflector are axially displaceable relative to each other during operation of the portable light to produce different modes of light reflection, and further including a lever arm disposed within the housing and configured to engage one of the reflectors to axially displace it relative to the other reflector; and a mode switch positioned adjacent to the handle; wherein the mode switch is operatively connected to the one reflector via the lever arm, such that activation of the mode switch causes the lever arm to move the one reflector to a second position along the projection axis, and deactivation of the mode switch causes the lever arm to allow the one reflector to return to the first position.

2. A portable light as set forth in claim 1, wherein the first reflector and the second reflector combine to define a substantially parabolic reflective surface in the first position.

3. A portable light as set forth in claim 2, wherein the light source is disposed at a focal point of the reflector assembly in the first position.

4. A handheld portable light, comprising:

a housing including a handle;

a reflector assembly disposed within the housing defining a projection axis, the reflector having an outer reflector defining a central opening, and an inner reflector disposed in the central opening of the outer reflector such that the outer reflector surrounds the inner reflector, the inner reflector movably mounted for axial movement along the projection axis relative to the outer reflector during operation of the portable light to produce different modes of light reflection; and a light source disposed within the housing, wherein the light source and the inner reflector are fixedly positioned together such that the position of the inner reflector relative to the light source does not vary, and further including a lever arm disposed within the housing and configured to engage the inner reflector to axially displace it relative to the outer reflector; and a mode switch positioned adjacent to the handle; wherein the mode switch is operatively connected to the inner reflector via the lever arm, such that activation of the mode switch causes the lever arm to move the inner reflector forward to a second position, and deactivation of the mode switch causes the lever arm to allow the outer reflector to return to the first position.

5. A portable light as set forth in claim 4, wherein the inner reflector is biased to the first position.

6. A portable light as set forth in claim 4, wherein the outer reflector and the inner reflector combine to define a substantially parabolic reflective surface in the first position.

7. A portable light as set forth in claim 4, wherein the light source is disposed at a focal point of the reflector assembly in the first position.

8. A portable light as set forth in claim 4, wherein the outer reflector defines a circular cross section taken perpendicular to the projection axis.

9. A portable light as set forth in claim 4, further comprising a plurality of pins projecting rearward from the outer reflector through corresponding openings in the inner reflector for connecting the inner and the outer reflectors.

10. A portable light as set forth in claim 9, further comprising a plurality of springs, each disposed about a corresponding pin.

11. A handheld portable light, comprising:

a housing including a handle;

a reflector assembly disposed within the housing defining a projection axis, the reflector having an outer reflector defining a central opening, and an inner reflector disposed in the central opening of the outer reflector such that the outer reflector surrounds the inner reflector, the outer reflector movably mounted for axial movement along the projection axis relative to the inner reflector during operation of the portable light to produce different modes of light reflection and biased to a first position such that the inner reflector and the outer reflector define a substantially parabolic surface; and a light source disposed within the housing, wherein the light source and the inner reflector are fixedly positioned together at a focal point thereof such that the position of the inner reflector relative to the light source does not vary, and further including a lever arm disposed within the housing and configured to engage the outer reflector to axially displace it relative to the inner reflector; and a mode switch positioned adjacent to the handle; wherein the mode switch is operatively connected to the outer reflector via the lever arm, such that activation of the mode switch causes the lever arm to move the outer reflector rearward to a second position, and deactivation of the mode switch causes the lever arm to allow the outer reflector to return to the first position.

12. A portable light as set forth in claim 11, further comprising a plurality of pins projecting rearward from the outer reflector through corresponding openings in the inner reflector for connecting the inner and the outer reflectors.

13. A portable light as set forth in claim 12, further comprising a plurality of springs, each disposed about a corresponding pin.

* * * * *

UNITED STATES PATENT AND TRADEMARK OFFICE

CERTIFICATE OF CORRECTION

PATENT NO. : 7,682,038 B2
APPLICATION NO. : 11/205837
DATED : March 23, 2010
INVENTOR(S) : Brian Wood It is certified that error appears in the above-identified patent and that said Letters Patent is hereby corrected as shown below:

On the title page item (73), Assignee should read --The Brinkmann Corporation--

Column 6, line 4, "outer" should be --inner--

Signed and Sealed this

Sixth Day of July, 2010

David J. Kappos

David J. Kappos
*Director of the United States Patent and Trademark Office*